US010363587B2

(12) United States Patent
Wada

(10) Patent No.: US 10,363,587 B2
(45) Date of Patent: Jul. 30, 2019

(54) BRISTLE ELEMENT FOR BRUSH AND BRUSH ROLL

(71) Applicant: HOTANI CO., LTD., Kimino-cho (JP)

(72) Inventor: Hiroki Wada, Kimino-cho (JP)

(73) Assignee: HOTANI CO., LTD., Kimino-cho (JP)

( * ) Notice: Subject to any disclaimer, the term of this patent is extended or adjusted under 35 U.S.C. 154(b) by 55 days.

(21) Appl. No.: 15/312,072

(22) PCT Filed: May 11, 2016

(86) PCT No.: PCT/JP2016/063969
§ 371 (c)(1),
(2) Date: Nov. 17, 2016

(87) PCT Pub. No.: WO2016/181984
PCT Pub. Date: Nov. 17, 2016

(65) Prior Publication Data

US 2017/0087611 A1 Mar. 30, 2017

(30) Foreign Application Priority Data

May 11, 2015 (JP) ..... 2015-096545

(51) Int. Cl.
*B24B 5/37* (2006.01)
*B21B 28/04* (2006.01)
(Continued)

(52) U.S. Cl.
CPC ..... *B21B 28/04* (2013.01); *A46B 13/001* (2013.01); *A46B 13/003* (2013.01); *A46D 1/00* (2013.01);
(Continued)

(58) Field of Classification Search
CPC ..... B24D 3/28; B24D 13/10; B24B 28/04; A46B 13/003; A46D 13/003; A46D 1/0207; A46D 1/0261
(Continued)

(56) References Cited

U.S. PATENT DOCUMENTS 5,944,587 A * 8/1999 Stadtfeld ..... B24B 3/00 451/48
2013/0157544 A1* 6/2013 McArdle ..... B24B 29/02 451/59
2015/0017888 A1* 1/2015 Idzko ..... B24D 13/10 451/59

FOREIGN PATENT DOCUMENTS

CN 1371643 A 10/2002
CN 101157198 A 4/2008
(Continued)

OTHER PUBLICATIONS

International Search Report dated Jun. 7, 2016 from International Application No. PCT/JP2016/063969, 2 pages.
(Continued)

*Primary Examiner* — Robert A Rose
(74) *Attorney, Agent, or Firm* — MH2 Technology Law Group, LLP

(57) ABSTRACT

The invention provides a brush bristle and a brush roll that exhibit a suitable abrasive force and that can reduce or eliminate the abrasion of a mill roll as much as possible. The brush bristle is for use in a brush roll B configured to scour a mill roll for rolling a metal sheet S, and includes one or more monofilaments 2 made of a thermoplastic resin containing abrasive particles. The abrasive particles have a hardness lower than the hardness of the mill roll, and higher than the hardness of the metal sheet S.

6 Claims, 3 Drawing Sheets

(51) Int. Cl.

| | |
|---|---|
| ***A46D 1/00*** | (2006.01) |
| ***B24D 3/00*** | (2006.01) |
| ***B24D 11/00*** | (2006.01) |
| ***B24D 13/10*** | (2006.01) |
| ***D01F 1/10*** | (2006.01) |
| ***A46B 13/00*** | (2006.01) |
| ***B24D 3/28*** | (2006.01) |
| ***B24B 27/033*** | (2006.01) |
| *D01F 6/60* | (2006.01) |

(52) U.S. Cl.
CPC ..... *A46D 1/0207* (2013.01); *A46D 1/0261* (2013.01); *B24B 5/37* (2013.01); *B24B 27/033* (2013.01); *B24D 3/00* (2013.01); *B24D 3/28* (2013.01); *B24D 11/00* (2013.01); *B24D 13/10* (2013.01); *D01F 1/10* (2013.01); *A46B 2200/3093* (2013.01); *D01F 6/60* (2013.01)

(58) Field of Classification Search
USPC ..... 451/526, 532, 464, 465, 59
See application file for complete search history.

(56) References Cited

FOREIGN PATENT DOCUMENTS

| | | | |
|---|---|---|---|
| JP | H06-055460 | A | 3/1994 |
| JP | H07-109620 | A | 4/1995 |
| JP | 2000-129478 | A | 5/2000 |
| JP | 2001-502185 | A | 2/2001 |
| JP | 2005-000310 | A | 1/2005 |
| JP | 2007-136594 | A | 6/2007 |
| JP | 2010-137295 | A | 6/2010 |
| WO | 1996/033638 | A1 | 10/1996 |

OTHER PUBLICATIONS

Chinese Office Action dated Dec. 26, 2018 for Chinese Patent Application No. 201680001420.9, 14 pages with English translation.

Zhihong Li, "Ceramic Mold Manufacturing", Standards Press of China, Sep. 30, 2000, p. 235 (See the translation of Chinese Office Action dated Dec. 26, 2018 for a concise explanation of the relevance of this document, which is referred to as File 3 in the Office Action).

* cited by examiner

BRISTLE ELEMENT FOR BRUSH AND BRUSH ROLL

CROSS-REFERENCE TO RELATED APPLICATIONS

This application is a U.S. National Stage application of PCT/JP2016/063969 filed 11 May 2016, which claims priority to Japanese Application No. 2015-096545 filed 11 May 2015, the entire disclosures of which are hereby incorporated by reference in their entireties.

TECHNICAL FIELD

The present invention relates to brush bristles for use in a brush roll configured to scour the work rolls of rolling machines, or backup rolls of work rolls, and also relates to the brush roll.

BACKGROUND ART

During the rolling of metal sheets (e.g., iron and aluminum), contaminants, such as debris of the metal sheets (metal debris) adhered to the surface of the metal sheets, are adhered to the work rolls of the rolling machine or the backup rolls of the work rolls (hereinafter "mill roll"). The contaminants such as metal debris adhered to the mill roll may reduce the quality of the surface of the rolled metal sheets. To prevent this, the contaminants, such as metal debris, adhered to the mill roll must be removed. To remove the contaminants such as metal debris, a brush roll, for instance, is used.

The brush roll rotates at high speed with its brush bristles pressed against the surface of the mill roll to scour the surface of the mill roll. The brush bristles are produced, for example, by incorporating abrasive particles into filaments made of a thermoplastic resin, such as nylon 6, nylon 66, nylon 612, and nylon 12. Examples of typically incorporated abrasive particles include silicon carbide and aluminum oxide (e.g., see Patent Literature 1).

CITATION LIST

Patent Literature

Patent Literature 1: JPH07-109620A

SUMMARY OF INVENTION

Technical Problem

When used as abrasive particles, silicon carbide or aluminum oxide, due to their high hardness, scrapes off contaminants (e.g., metal debris) adhered to a mill roll in an excellent manner, exerting an excellent abrasive force on the mill roll. However, due to their overly strong abrasive force, such abrasive particles scrape away the mill roll itself, and overly abrade the mill roll.

The present invention was accomplished with a focus on this problem. An object of the invention is to provide a brush bristle having a suitable abrasive force, and that is capable of reducing or eliminating the abrasion of the mill roll as much as possible; and to provide a brush roll.

Solution to Problem

The object of the present invention is achieved by a brush bristle for use in a brush roll configured to scour a mill roll for rolling a metal sheet, the brush bristle comprising one or more monofilaments made of a thermoplastic resin containing abrasive particles, with the Vickers hardness of the abrasive particles being lower than the Vickers hardness of the mill roll and higher than the Vickers hardness of the metal sheet, falling within the range of HV 80 to HV 450.

In the brush bristle as described above, the abrasive particles are preferably particles of iron or particles of a non-ferrous metal. Of these, the abrasive particles are more preferably steel grit.

The abrasive particles may be porous carbon particles obtained by baking a mixture containing at least bran and a phenol resin.

The object of the present invention is also achieved by a brush roll comprising the brush bristles described above.

Advantageous Effects of Invention

The brush bristle and the brush roll according to the present invention have a suitable abrasive force, and can reduce or eliminate the abrasion of a mill roll as much as possible.

Description of Embodiments

Figure 1:
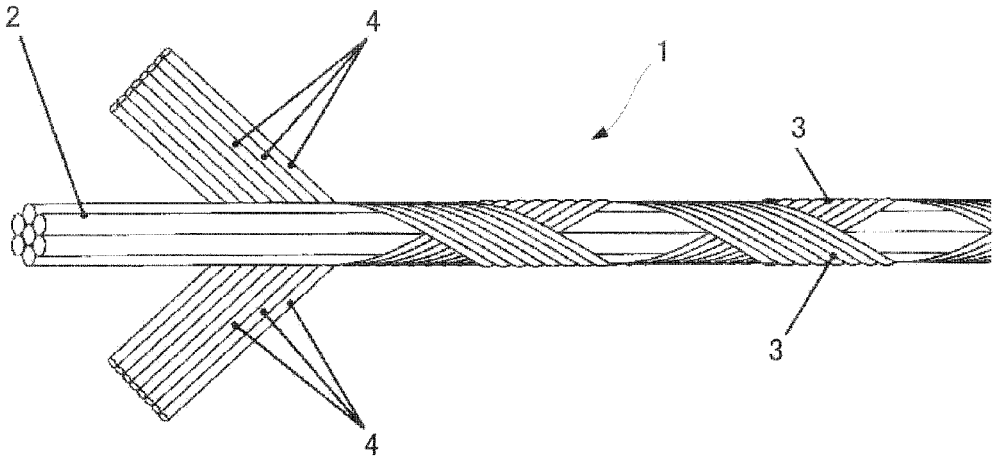
FIG. 1 is a perspective view illustrating a brush bristle according to one embodiment of the present invention.
Figure 2:
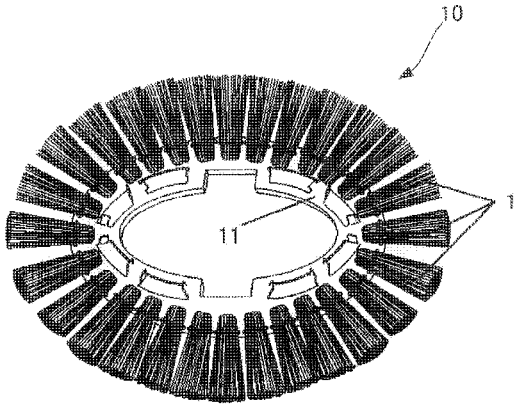
FIG. 2 is a perspective view illustrating an example of a brushing member.
Figure 3:
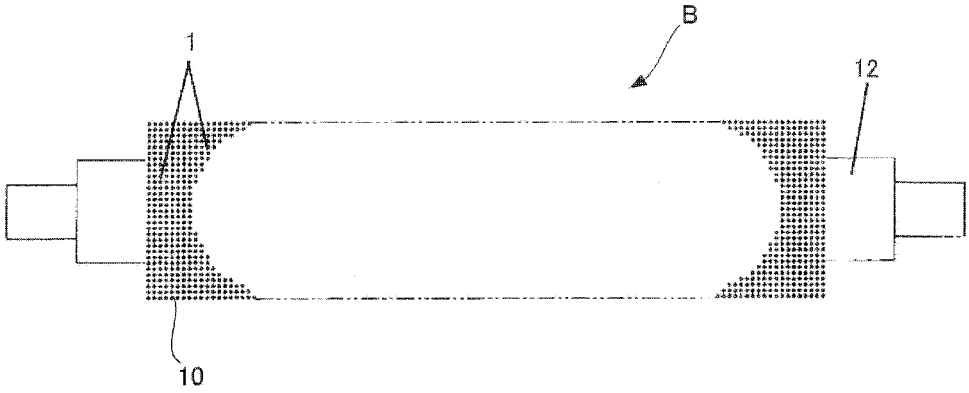
FIG. 3 is a schematic front view illustrating a brush roll.
Figure 4:
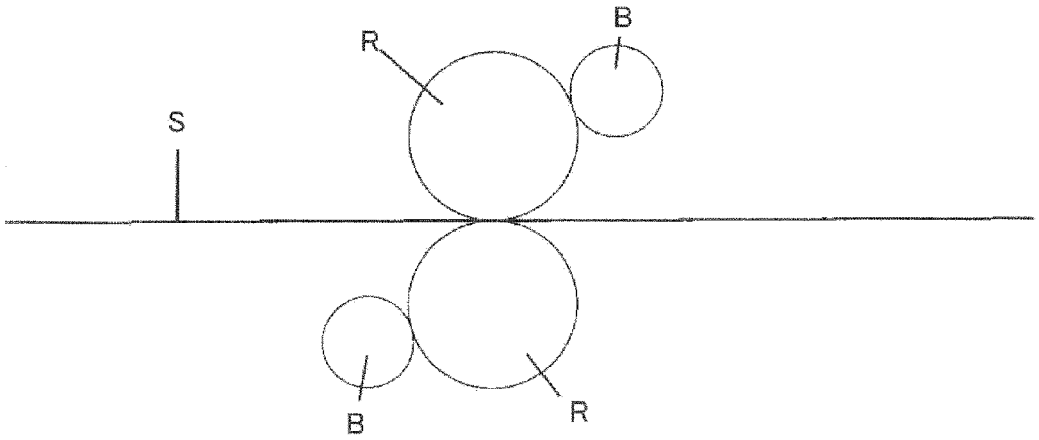
FIG. 4 is an explanatory diagram illustrating an example of the use of the brush roll.
Figure 5:
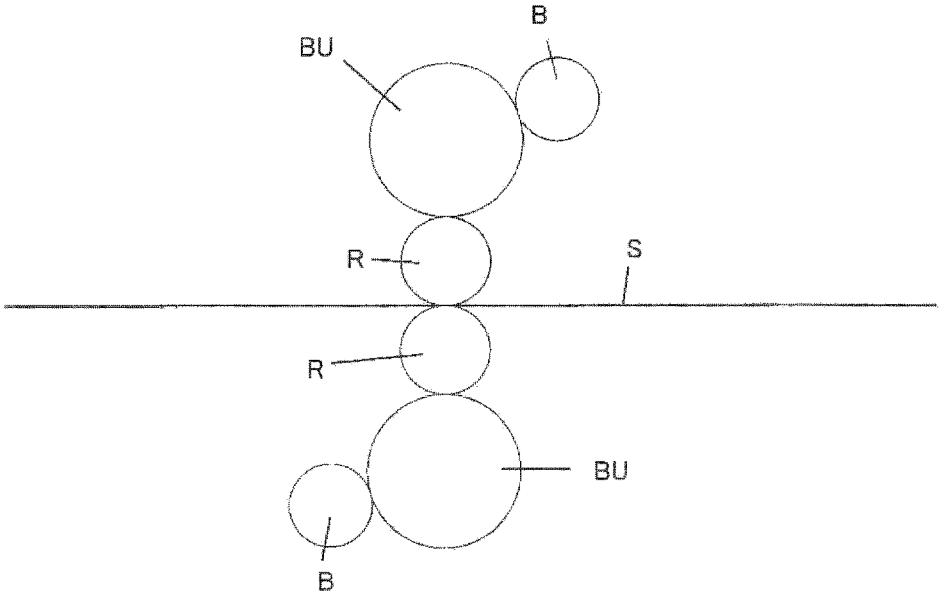
FIG. 5 is an explanatory diagram illustrating another example of the use of the brush roll.

The following describes embodiments of the present invention with reference to the attached drawings. FIG. 1 illustrates a brush bristle 1 according to an embodiment of the present invention. FIG. 2 illustrates an example of a brush member (brush disc 10) for a brush roll that comprises the brush bristles 1 according to an embodiment of the present invention. In the brush disc 10, a plurality of brush bristles 1 are densely implanted in the periphery of a disc-shaped disc 11. The plurality of brush bristles 1 are passed through holes (not shown) pierced in the outer periphery of the disc 11, and folded into a horseshoe shape. After folding, anchors of the plurality of folded bristles 1 are tightened with a metal wire (not shown) to fix the plurality of brush bristles 1 on the periphery of the disc 11. A plurality of discs 11 are attached to a shaft 12 of a brush roll so as to concurrently rotate, thereby forming a brush roll B as shown in FIG. 3. The brush roll B is used to scour the surface of a work roll R of a rolling machine configured to roll a metal sheet S, such as iron and aluminum, (see FIG. 4), or to scour the surface of a backup roll BU of the work roll R (see FIG. 5). Hereinbelow, the work roll R and the backup roll BU are sometimes collectively referred to as "mill roll."

The brush bristle 1 according to this embodiment of the invention is formed from one or more monofilaments 2 whose cross-sectional surface has a circular shape, as shown in FIG. 1. The brush bristle 1 shown in FIG. 1 has a core thread formed of a plurality of monofilaments 2 (7 monofilaments in FIG. 1), and a covering yarn 3 covers the outer circumference of the core thread to form the brush bristle 1. However, the brush bristle 1 may be formed by covering a core thread formed of a single monofilament 2 by the covering yarn 3. The brush bristle 1 may also be formed without covering the outer circumference of the core thread (one or more monofilaments 2) by the covering yarn 3. There is no particular limitation to the diameter of the monofilament 2. However, when a single monofilament 2 forms the core thread, the diameter is preferably 0.2 mm to 3.0 mm. When the diameter of the monofilament 2 is less than the diameter within the numerical range, the monofilament 2 has low firmness, providing the brush bristle 1 with a small abrasive force. On the other hand, when the diameter of the monofilament 2 is more than the diameter within the numerical range, the monofilament 2 has high firmness, making the brush bristle 1 hard and unpliable. This makes it difficult to implant such brush bristles 1 into the disc 11, for example. When a plurality of monofilaments 2 form the core thread, it is preferable to set the diameter of each monofilament 2 so that the diameter of the entire core thread is 0.4 mm to 5.0 mm.

Examples of materials for the monofilament 2 include thermoplastic resins, such as polyester, polyamide, and polyolefin. Specific examples of polyamide include nylon 6, nylon 66, nylon 610, nylon 612, and nylon 12. Specific examples of polyester include polyethylene terephthalate (PET) and polybutylene terephthalate (PBT).

Figure 6:
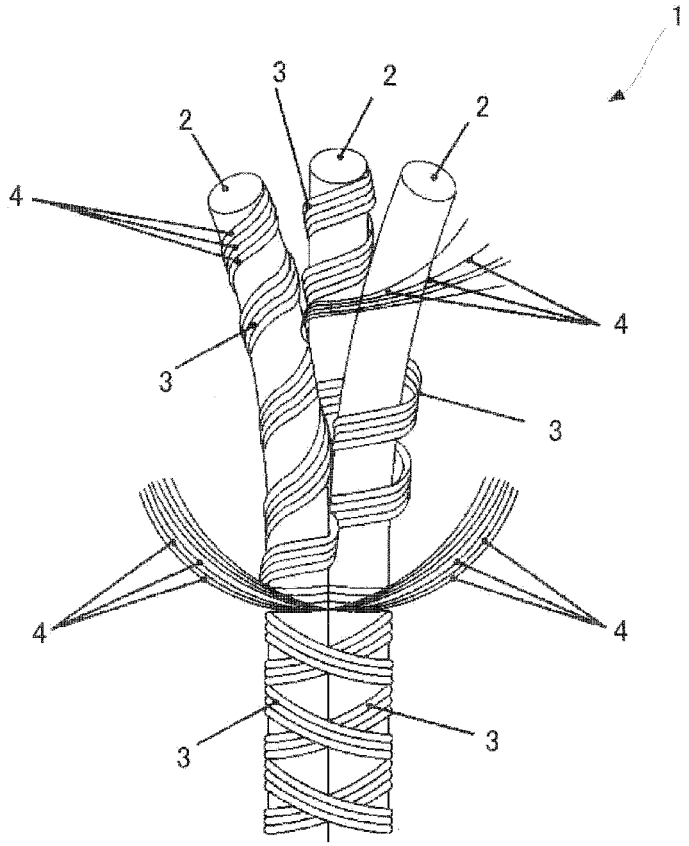
FIG. 6 is a perspective view illustrating the brush bristle according to another embodiment of the present invention.

The covering yarn 3, which is, for example, a multifilament yarn formed from multiple ultrafine monofilament yarns 4 made of a synthetic resin, such as nylon, polyester, and polypropylene, is spirally wound around the outer circumference of the core thread (one or more monofilaments 2), and fixed with an adhesive made from a synthetic resin to cover the outer circumference of the core thread (one or more monofilaments 2). This covering yarn 3 may be a single monofilament yarn spirally wound around the outer circumference of the core thread (one or more monofilaments 2), or a braided multifilament yarn wound around the outer circumference of the core thread. Moreover, in the case of a core thread formed from a plurality of monofilaments 2 as shown in FIG. 6, each monofilament 2 may be covered by the covering yarn 3, and the plurality of monofilaments 2 (3 monofilaments in FIG. 6) that are each covered by the covering yarn 3 may be bundled together and further covered by the covering yarn 3.

The monofilament 2 contains abrasive particles (not shown). In this embodiment, the abrasive particles contained in the monofilament 2 have a hardness lower than the hardness of the mill roll (work roll R or backup roll BU) to be scoured by the brush bristles 1 (brush roll B), and higher than the hardness of the metal sheet S to be rolled by the mill roll.

The hardness of the abrasive particles being higher than the hardness of the metal sheet S to be rolled enables the brush bristles 1 to scrape off the metal debris of the metal sheet S adhered to the mill roll, enabling the brush bristles 1 to exert an excellent abrasive force on the mill roll. In addition, the hardness of the abrasive particles being lower than the hardness of the mill roll to be scoured can reduce or eliminate the chance of the brush bristles 1 scraping away the mill roll itself, effectively preventing the mill roll from being overly abraded. Because the brush bristle 1 in this embodiment contains abrasive particles having the hardness described above, the brush bristle 1 exhibits an excellent scouring performance on the mill roll and achieves uniform and smooth surface properties of the mill roll, while effectively reducing or eliminating the amount of abrasion of the mill roll.

The comparison of the hardness of the abrasive particles, mill roll, and metal sheet S can be made using, for example, the Vickers hardness measured in the Vickers hardness test (JIS Z2244). The hardness of the metal sheet S made of aluminum, for example, is indicated as a Vickers hardness of about HV 80 as measured by applying an indentation load F of 1 kgf. The hardness of the metal sheet S made of iron, for example, is indicated as a Vickers hardness of about HV 200 to 500 as measured by applying an indentation load F of 1 kgf. The hardness of the metal sheet S made of stainless steel, for example, is indicated as a Vickers hardness of about HV 200 to 300 as measured by applying an indentation load F of 1 kgf. The hardness of the mill roll made of typically used high-carbon chromium steel is indicated as a Vickers hardness of about HV 600 to 900 as measured by applying an indentation load F of 1 kgf. The hardness of the mill roll made of high-speed steel is indicated as a Vickers hardness of about HV 550 to 750 as measured by applying an indentation load F of 1 kgf. Therefore, the hardness of the abrasive particles indicated by Vickers hardness is preferably within the range of HV 80 to 640, and more preferably HV 100 to 600 as measured by applying an indentation load F of 1 kgf. Although the comparison of the hardness of the abrasive particles, mill roll, and metal sheet S has been made using the Vickers hardness as measured by applying an indentation load F of 1 kgf, the comparison may also be made using the Vickers hardness measured by applying an indentation load F of other than 1 kgf, as long as the measurement conditions are the same. In addition to the Vickers hardness, a variety of indices that indicate hardness are available. The hardness of the abrasive particles, mill roll, and metal sheet S may be compared using Rockwell hardness or Brinell hardness measured in the Rockwell hardness test (JIS Z2245) or Brinell hardness test (JIS Z2243), or Shore hardness measured with a Shore hardness tester (JIS Z2246). The measured Rockwell hardness, Brinell hardness, or Shore hardness may be converted to a Vickers hardness for comparison using a hardness conversion table (e.g., SAE J417) or a conversion formula.

Examples of abrasive particles having the hardness described above include particles made of iron and particles made of a non-ferrous metal, such as steel and specialty steel. Of these, in particular, steel grit with at least one sharp angle is a preferable example. Steel grit refers to quenched polygonal particles with high hardness, and preferable examples of steel grit include "TG-20" produced by IKK Shot Co., Ltd. The hardness of this steel grit is indicated as a Vickers hardness of about HV 450. Any materials may be used, as long as the materials have a hardness lower than the hardness of the mill roll and higher than the hardness of the metal sheet S. Examples of such materials with a sharp angle include steel cut wire and stainless cut wire that are obtained by cutting metal wire. Examples of such materials having a spherical shape with no sharp angle include spherical particles of iron or steel, such as steel shots, steel beads, stainless shots, and stainless beads.

In addition, examples of abrasive particles having the hardness described above include porous carbon particles obtained by baking a mixture containing at least bran and a phenol resin. The porous carbon particles can be produced by adding a suitable amount of an aqueous solution of starch or water to a mixture of bran, such as degreased rice bran or gluten, with a phenol resin, kneading the mixture, baking the kneaded mixture for carbonization in vacuum or inert gas, cooling the result, and pulverizing the cooled matter for classification. Preferable examples include RB ceramic powder (RBC powder) produced by Sanwa Yushi Co., Ltd. The hardness of the RBC powder indicated by Vickers hardness is about HV 440.

The size of the abrasive particles (particle size) is preferably within the range of #36 to #3000, and particularly preferably within the range of #150 to #1000 as indicated by the abrasive number prescribed in Abrasive Particle Size JIS R6001.

The amount of the abrasive particles to be added to a thermoplastic resin for the monofilament 2 is as follows. When the abrasive particles are steel grit, for example, the abrasive particles are added preferably in an amount of 20 parts by weight to 60 parts by weight, and more preferably 40 parts by weight to 50 parts by weight, per 100 parts by weight of the thermoplastic resin. While the amount of the abrasive particles being less than the numerical ranges described above may result in brush bristles 1 having an insufficient abrasive force, the amount of the abrasive particles being more than the numerical ranges described above may reduce the strength of the monofilament 2, leading to lowered break resistance of the brush bristles 1. In addition to the abrasive particles, an antidegradant or other additives may suitably be added to the thermoplastic resin.

As in a known spinning method, the monofilament 2 containing the abrasive particles can be produced by mixing a thermoplastic resin and abrasive particles, subjecting the mixture to melt-spinning using a melt spinner, cooling the resulting filaments, and optionally drawing the filaments.

In the brush bristle 1 with the features described above and the brush roll B comprising the brush bristles 1, because the hardness of the abrasive particles contained in the monofilament 2 is higher than the hardness of the metal sheet S to be rolled by the mill roll, the brush bristles 1 can scrape off the metal debris of the metal sheet S adhered to the mill roll from the surface of the mill roll in an excellent manner. Thus, the brush bristles 1 can exert an excellent abrasive force on the mill roll. In addition, because the hardness of the abrasive particles contained in the monofilament 2 is lower than the hardness of the mill roll to be scoured, the chance of the brush bristles 1 scraping away the mill roll itself can be reduced or eliminated. This makes it possible to effectively prevent the mill roll from being overly abraded by the brush bristles 1. Because of the suitable hardness of the abrasive particles contained in the monofilament 2, the brush bristles 1 and brush roll B in this embodiment exhibit excellent scouring performance on the mill roll and provide the mill roll with uniform and smooth surface properties, while effectively reducing or eliminating the amount of abrasion of the mill roll itself.

Although one embodiment of the present invention is described above, the invention is not limited to the embodiment. The present invention may be embodied in various other forms without departing from the spirit and principal concepts of the invention. For example, the cross-sectional surface of the monofilament 2 may have an elliptical shape, triangular shape, rectangular shape, or any shape other than a circular shape.

EXAMPLES

The following describes the present invention in more detail with reference to Examples and Comparative Examples. However, the present invention is not limited to these Examples.

Example 1

A single monofilament 2 with a diameter of 2.5 mm, made of nylon 6 containing steel grit with a particle size of 46 mesh as abrasive particles was prepared. About 940 strings of covering yarn 3 made of nylon 6 with each string having a diameter of 0.02 mm were wound around the single monofilament 2 in an S-twist direction (4-mm pitch), and then in an X-twist direction (4-mm pitch) to cover the monofilament 2. The covering yarn 3 wound around the outer circumference of the monofilament 2 was heated in a heat-treating furnace to allow the covering yarn 3 to adhere to the monofilament 2, thereby preparing brush bristles 1.

Thus-prepared brush bristles 1 were implanted into discs, and the 11 discs were stacked atop one another, thereby preparing a brush roll B. Each disc had 46 holes at regular intervals in the outer periphery, and 10 brush bristles 1 were implanted per hole. The outer diameter of the brush roll B was ϕ320 mm.

Comparative Example 1

The procedure of Example 1 was repeated except that silicon carbide instead of steel grit was incorporated as abrasive particles into the monofilament 2, thereby preparing a brush roll B.

Scouring Tests 1 and 2 were performed using the brush roll B prepared in Example 1 and the brush roll B prepared in Comparative Example 1 under the following conditions, and then the scoured amount was measured. In Scouring Test 1, steel (HAP40, Hitachi Metals Tool Steel, Ltd.) typically used as a material for mill rolls of rolling machines was prepared in a sheet form. A commercially available spray coating composition was applied onto the surface of the steel to form contaminants. The surface of the steel on which the contaminants were adhered was scoured for 5 seconds at a brush rotation frequency of 900 rpm and a rolling reduction of 1 mm (with the brush roll B being pressed against the surface of the steel by 1 mm after one point of the outer circumference of the brush roll B came in contact with the surface of the steel) while warm water at 30° C. was sprayed. Thereafter, the amount of the scoured contaminants was measured. In Scouring Test 2, the surface of the same type of sheet-shaped steel as used in Scouring Test 1 (HAP40, Hitachi Metals Tool Steel, Ltd.) was scoured for 300 seconds under the same conditions as in Scouring Test 1 except for the scouring time period, specifically at a brush rotation frequency of 900 rpm and a rolling reduction of 1 mm while warm water at 30° C. was sprayed. Thereafter, the amount of the scoured steel was measured. Table 1 shows the measurement results. In Scouring Test 1, to determine the amount of the scoured contaminants, first, the weight of the steel is measured before contaminants are formed on the surface, and then the weight of the steel having contaminants formed on the surface is measured. The difference in weight is calculated to determine the weight of the contaminants per unit area before scouring ($g/m^2$). Then, the weight of the steel having contaminants adhered to the surface is measured after scouring. From the difference in weight between steel alone and steel with contaminants, the weight of the contaminants per unit area ($g/m^2$) after scouring is determined. Subsequently, the weight of the contaminants per unit area ($g/m^2$) before scouring is compared with the weight of the contaminants per unit area ($g/m^2$) after scouring to determine the amount of scoured contaminants. In Scouring Test 2, to determine the amount of scoured steel, the weight of the steel before scouring is measured, and then the weight of the steel after scouring is measured. The weight of the steel per unit area ($g/m^2$) before scouring is compared with the weight of the steel per unit area ($g/m^2$) after scouring to determine the amount of the scoured steel.

TABLE 1

| | Amount of Scoured Contaminants | Amount of Scoured Steel |
|---|---|---|
| Example 1 | 20.00 $g/m^2$ | 0.22 $g/m^2$ |
| Comparative Example 1 | 11.78 $g/m^2$ | 11.56 $g/m^2$ |

As is clear from Table 1, regarding the removability of the contaminants, the brush roll B comprising brush bristles formed from steel grit-containing monofilaments 2 of Example 1 can remove the contaminants adhered to the surface of the steel (mill roll) to an equivalent or higher degree compared with the brush roll B comprising brush bristles formed from silicon carbide-containing monofilaments 2 of Comparative Example 1. Regarding the scouring performance on the surface of the steel (mill roll), while the brush roll B of Comparative Example 1 overly abraded the surface of the steel (mill roll), the brush roll B of Example 1 abraded almost no steel (mill roll). Therefore, the brush roll B comprising brush bristles formed from steel grit-containing monofilaments 2 of Example 1, due to its suitable abrasive force, can remove the contaminants adhered to the surface of the steel (mill roll) in an excellent manner, while being capable of reducing or eliminating the abrasion of the mill roll as much as possible because of almost no abrasion of steel (mill roll).

DESCRIPTION OF THE REFERENCE SYMBOLS

1 brush bristles
2 monofilament
B brush roll
S metal sheet
R work roll
BU backup roll

The invention claimed is:

1. A brush bristle for use in a brush roll configured to scour a mill roll for rolling a metal sheet, the bristle comprising one or more monofilaments made of a thermoplastic resin containing abrasive particles, the abrasive particles having a Vickers hardness lower than a Vickers hardness of the mill roll and higher than a Vickers hardness of the metal sheet, the Vickers hardness of the abrasive particles being in a range of HV 80 to HV 450.

2. The brush bristle according to claim 1, wherein the abrasive particles are particles of iron or particles of a non-ferrous metal.

3. The brush bristle according to claim 2, wherein the abrasive particles are steel grit.

4. A brush roll comprising brush bristles, each of the brush bristles being the brush bristle according to claim 1.

5. A brush roll comprising brush bristles, each of the brush bristles being the brush bristle according to claim 2.

6. A brush roll comprising brush bristles, each of the brush bristles being the brush bristle according to claim 3.

* * * * *